United States Patent [19]

Ernst

[11] Patent Number: 4,998,311

[45] Date of Patent: Mar. 12, 1991

[54] GOLF CART CUSHION

[76] Inventor: Wilbur L. Ernst, 6136 Woodcrest Dr., Tuscaloosa, Ala. 35405

[21] Appl. No.: 509,065

[22] Filed: Apr. 13, 1990

[51] Int. Cl.[5] ..... A47C 27/10

[52] U.S. Cl. ..... 5/455; 5/448; 5/465; 297/219

[58] Field of Search ..... 5/465, 448, 455, 475, 5/451; 297/219, DIG. 3; 280/DIG. 5

[56] References Cited

U.S. PATENT DOCUMENTS

| | | | |
|---|---|---|---|
| 3,568,225 | 3/1971 | Radke | 5/465 |
| 3,603,639 | 9/1971 | Wilson | 297/219 |
| 3,659,297 | 5/1972 | Schutz | 5/465 |
| 3,707,008 | 12/1972 | Fellin et al. | 5/465 |
| 3,722,455 | 3/1973 | Trotman | 297/453 |
| 3,804,462 | 4/1974 | Kobayashi | 297/453 |
| 3,840,923 | 10/1974 | Bos | 5/482 |
| 3,940,183 | 2/1976 | Seltzer et al. | 297/453 |
| 4,143,916 | 3/1979 | Trotman et al. | 297/453 |
| 4,190,918 | 3/1980 | Harvell | 5/465 |
| 4,930,591 | 6/1990 | Lanius et al. | 280/DIG. 5 |

*Primary Examiner*—Alexander Grosz
*Attorney, Agent, or Firm*—Jean Gilden

[57] ABSTRACT

A golf cart cushion is utilized in association with a golf cart, wherein the cushion includes a medial transverse seam defining aligned pockets, wherein each pocket includes a perimeter opening at each end to receive slidably therewithin a cushion insert. Each pocket includes a hook and loop fastener closure surface in surrounding relationship relative to each opening. Each cushion includes a matrix of coil springs therewithin. The cushion is formed of an air permeable fluid absorbent fabric. A modification of the cushion insert includes an insert opening with an insert opening hook and loop fastener surface to effect selective closure and opening of the opening of the insert, where the opening of the insert receives a selective number of tubular spring members to permit selective firmness relative to the cushion insert.

The tubular members each include hook and loop fastener side surfaces to permit engagement and securement of the insert members together within the cushion insert.

8 Claims, 4 Drawing Sheets

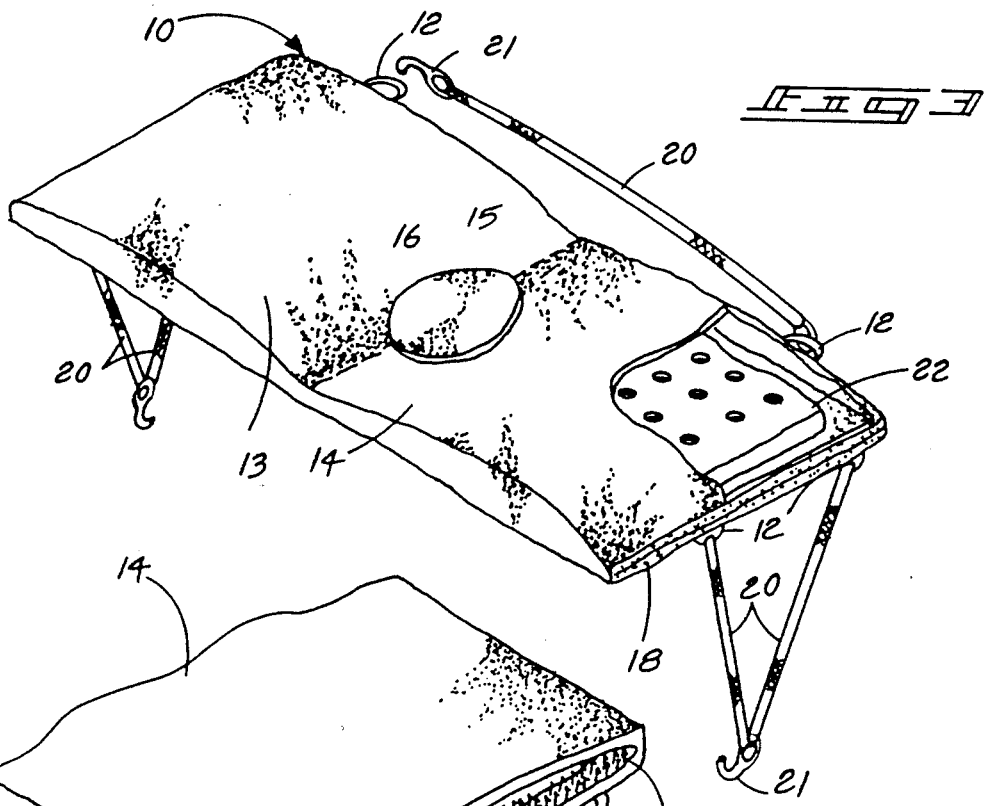
Fig 3
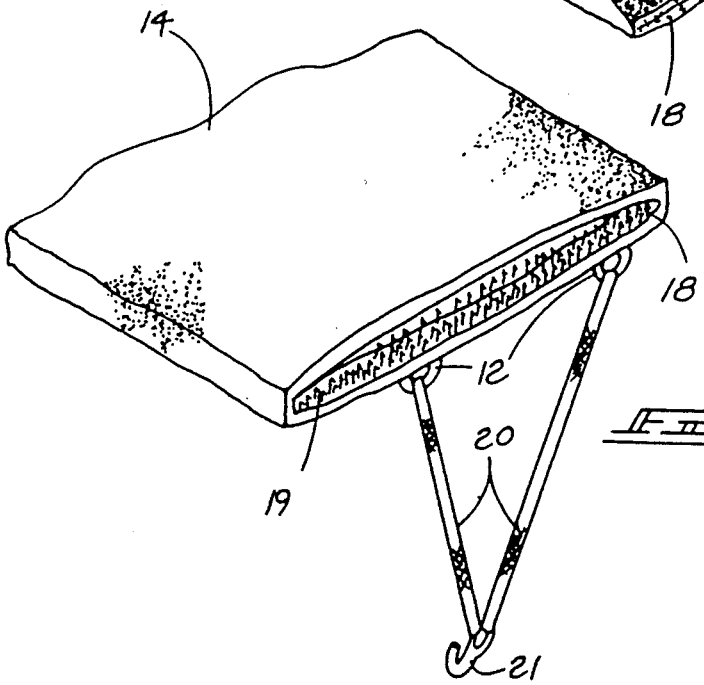
Fig 4
Fig 5
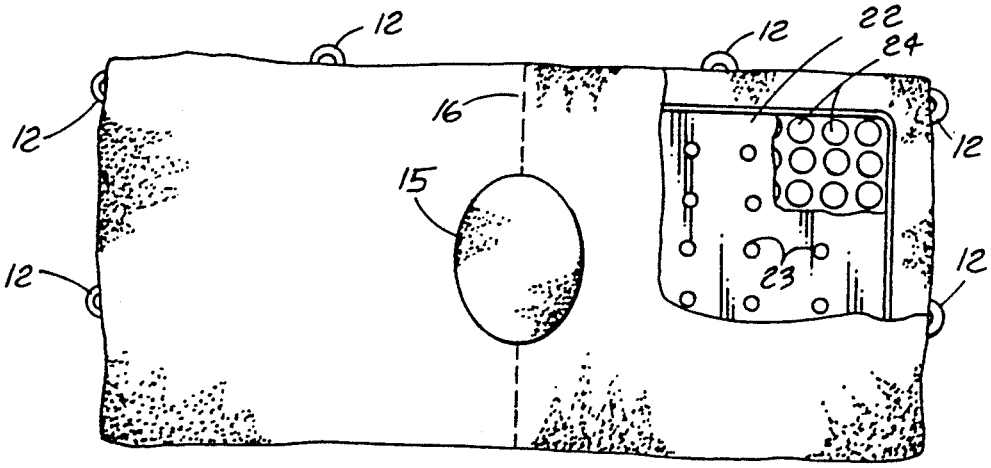

GOLF CART CUSHION

BACKGROUND OF THE INVENTION

1. Field of the Invention

The field of invention relates to cushions, and more particularly pertains to a new and improved golf cart vent cushion wherein the same is securable to an associated golf cart to enhance comfort in the use of the golf cart.

2. Description of the Prior Art

In a typical game of golf, players traverse the golf course in a self-propelled golf cart. Cushioning of such golf cart vehicles is desirable and even necessary to enhance ease of comfort of participants in the game. Inasmuch as cushioning is typically selective from one individual to the other, it is desirable to provide a cushioning member that accommodates such adjustment and variation within a cushion, and particularly cushions utilized in association with a golf cart. Prior art cushion structure may be found in U.S. Pat. No. 3,804,462 to Kobayashi wherein a ventilated seat structure is positionable upon an automotive seat, wherein a mesh framework includes a generally bow-shaped support within the framework to provide integrity to the framework of the seat.

U.S. Pat. No. 4,143,916 to Trotman, et al. sets forth a ventilating seat cushion defining a grid in the form of a sheet of resilient plastic material having a plurality of protuberances arranged in columns and rows to support the body in a spaced relationship to an underlying surface.

U.S. Pat. No. 3,722,955 to Trotman sets forth a ventilating structure wherein a cover sheet is formed with molded and recess portions defining a decorative pattern of the cover sheet to effect support and comfort in use of the organization.

U.S. Pat. No. 3,840,923 to Bos sets forth a ventilating cover or mat wherein a number of polygonal elements are secured together in offset rows to effect channels and columns to communicate ventilation through the organization.

U.S. Pat. No. 3,940,183 to Seltzer et al sets forth a seat panel formed with "T" shaped sections oriented in parallel rows and columns to effect rigidity of the organization in use, as well as permitting ventilation therethrough.

As such, it may be appreciated that there continues to be a need for a new and improved golf cart cushion wherein the same addresses both the problems of ease of use in association with a golf cart as well as effectiveness in construction to provide comfort to users thereof and in this respect, the present invention substantially fulfills this need.

SUMMARY OF THE INVENTION

In view of the foregoing disadvantages inherent in the known types of golf cart cushions now present in the prior art, the present invention provides a golf cart vent cushion wherein the same is readily and selectively securable to an associated golf cart to provide a resilient accommodating support surface to a participant in a golf game utilizing the golf cart. As such, the general purpose of the present invention, which will be described subsequently in greater detail, is to provide a new and improved golf cart cushion which has all the advantages of the prior art golf cart cushions and none of the disadvantages.

To attain this, the present invention includes a golf cart cushion utilized in association with a golf cart, wherein the cushion includes a medial transverse seam defining aligned pockets, wherein each pocket includes a perimeter opening to receive slidably therewithin a cushion insert. Each pocket includes a hook and loop fastener closure surface in surrounding relationship relative to each opening. Each cushion includes a matrix of coil springs therewithin. The cushion is formed of an air permeable fluid absorbent fabric. A modification of the cushion insert includes an insert including an insert opening with an insert opening hook and loop fastener surface to effect selective closure and opening of the opening of the insert, wherein the opening of the insert receives a selective number of tubular fluid filled members to permit selective forming of firmness relative to the cushion insert. The tubular members each include hook and loop fastener side surfaces to permit engagement and securement of the insert members together within the cushion insert.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved golf cart cushion which has all the advantages of the prior art golf cart cushions and none of the disadvantages.

It is another object of the present invention to provide a new and improved golf cart cushion which may be easily and efficiently manufactured and marketed.

It is a further object of the present invention to provide a new and improved golf cart cushion which is of a durable and reliable construction.

An even further object of the present invention is to provide a new and improved golf cart cushion which is susceptible of a low cost of manufacture with regard to both materials and labor, and which accordingly is then susceptible of low prices of sale to the consuming public, thereby making such golf cart cushion economically available to the buying public.

Still yet another object of the present invention is to provide a new and improved golf cart cushion which provides in the apparatuses and methods of the prior art some of the advantages thereof, while simultaneously overcoming some of the disadvantages normally associated therewith.

Still another object of the present invention is to provide a new and improved golf cart cushion wherein the same provides for a golf cart cushion structure utilizing pockets to permit selective reception of golf cart cushion inserts therewithin to enable maintenance and periodic cleaning of the cushion structure, as well as utilizing inserts of various resiliency and firmness to provide accommodation of individuals utilizing the cushion structure.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an isometric illustration, partially in section, of the instant invention.

FIG. 4 is an isometric end view of the instant invention illustrating the pocket opening structure utilized.

FIG. 5 is a top orthographic view of the instant invention, partially in section.

DESCRIPTION OF THE PREFERRED EMBODIMENT

Figure 1:
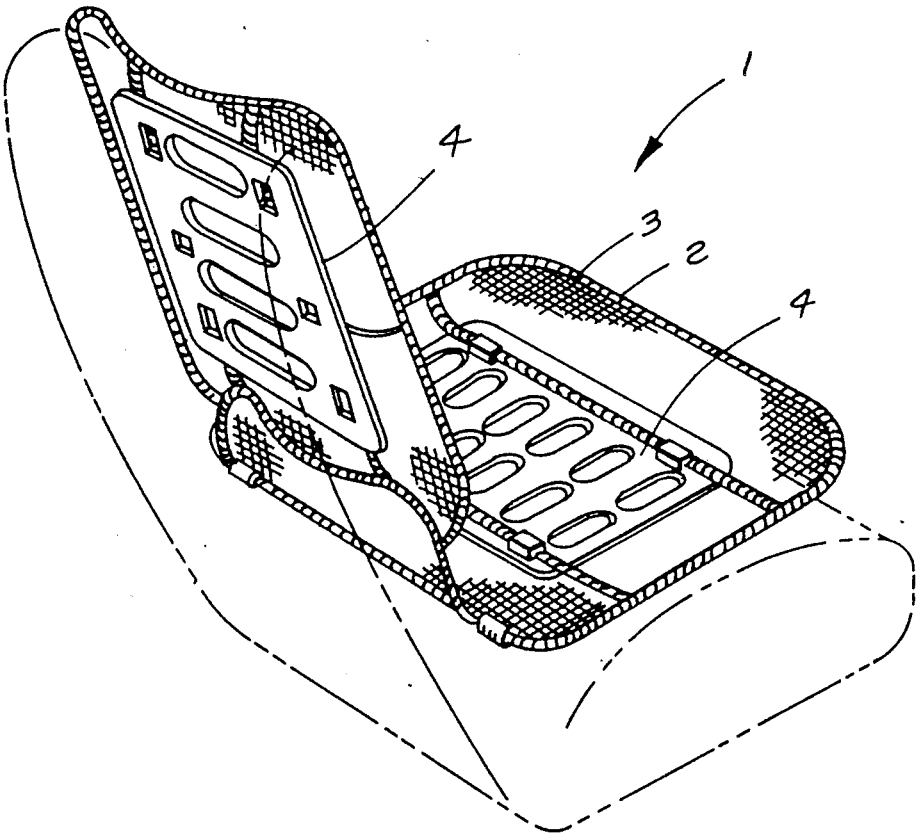
FIG. 1 is an isometric illustration of a prior art cushion structure.

With reference now to the drawings, and in particular to FIGS. 1 to 11 thereof, a new and improved golf cart cushion embodying the principles and concepts of the present invention and generally designated by the reference numeral 10 will be described.

FIG. 1 illustrates a prior art seat cushion 1, wherein a framework 2 includes a mesh 3 coextensively formed about the framework, with bow-shaped framework members 4 mounted medially within the vertical horizontal portions of the cushion to enhance support of an individual positioned thereon.

Figure 2:
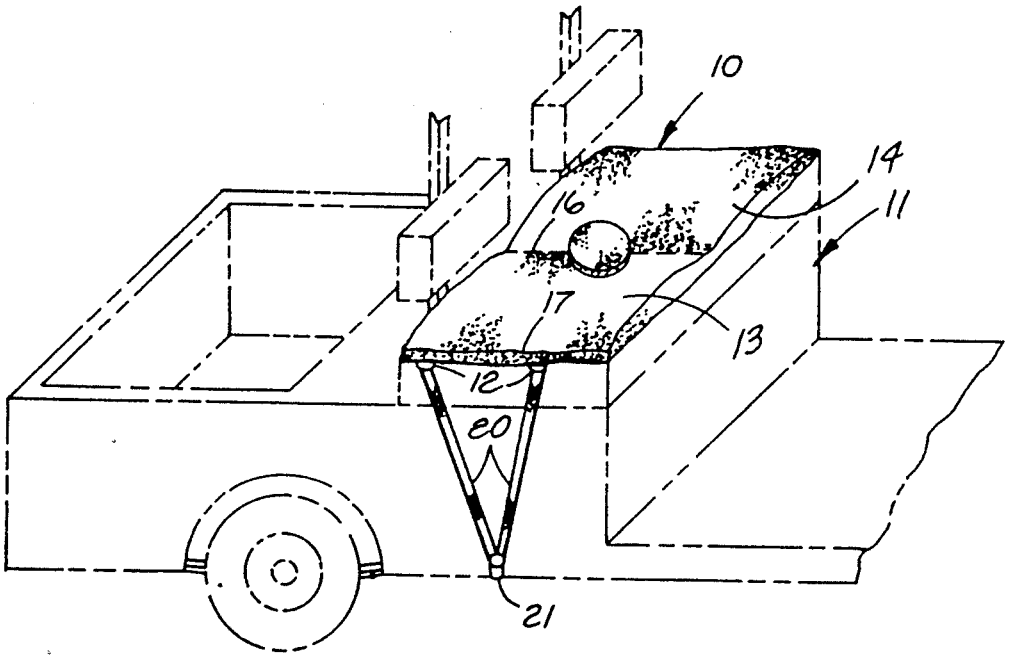
PRIOR ART Fig 2
FIG. 2 is an isometric illustration of the instant invention in association with a golf cart.
Figure 6:
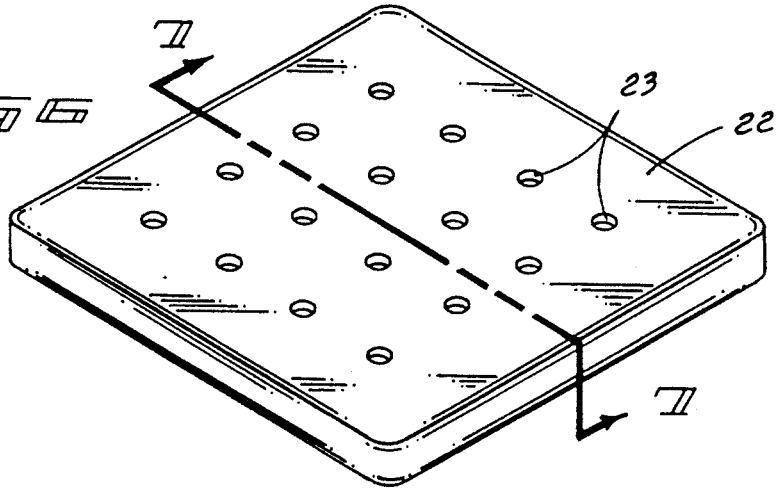
FIG. 6 is an isometric illustration of a cushion insert utilized by the instant invention.
Figure 7:
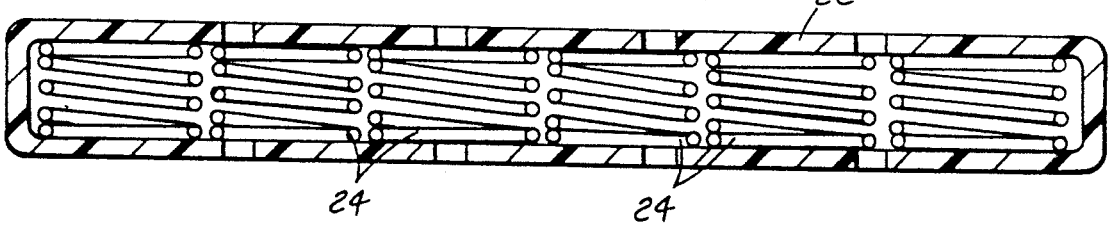
FIG. 7 is an orthographic view, taken along lines 7—7 of FIG. 6, in the direction indicated by the arrows.

More specifically, the golf cart cushion 10 of the instant invention essentially comprises a member formed of an air permeable fluid absorbent woven fabric mounted upon a self-propelled cart seat mounting platform 11. The cushion 10 includes plural pairs of mounting loops 12 mounted at each side of the cushion and at the end thereof for securement of the cushion to the golf cart utilizing elastomeric straps 20 directed from each of the pairs of mounting loops 12, wherein the straps 20 merge to a single junction, wherein a clip 21 permits mounting and securement of the cushion to the associated golf cart, as illustrated in FIG. 2 for example. First and second pockets 13 and 14 respectively define the cushion 10, wherein a medial seam 16 is transversely directed medially through the cushion 10 to define the pockets in a side-by-side relationship. A central logo patch 15 is positioned and mounted sprayed or stensiled overlying the medial seam 16 to accommodate various logos to be mounted thereon, as well as reinforcing the seam structure. Each of the respective pockets 13 and 14 includes a respective first and second pocket opening 17 and 18. Each pocket opening is coextensive with each end of the cushion and are directed in an opposing direction relative to one another. Each pocket opening is defined by a pocket hook and loop fastener perimeter loop 19 defining and formed about the interior surface of the respective openings 17 and 18 to permit selective opening and closure of the pockets 17 and 18 to receive enclosed cushion insert housings 22 therewithin. Each cushion insert housing 22 includes a series of cushion insert apertures 23 therethrough the surface of each insert housing to enhance airflow therethrough. A matrix of coil springs 24 are formed coextensively and contained within each insert housing 22. In this manner, various insert housings 22 may be inserted within the pockets 13 and 14 to permit use of insert housings containing springs 24 of various stiffnesses to provide an adjustable rigidity to each of the pockets and of the cushions 10 in use.

Figure 8:
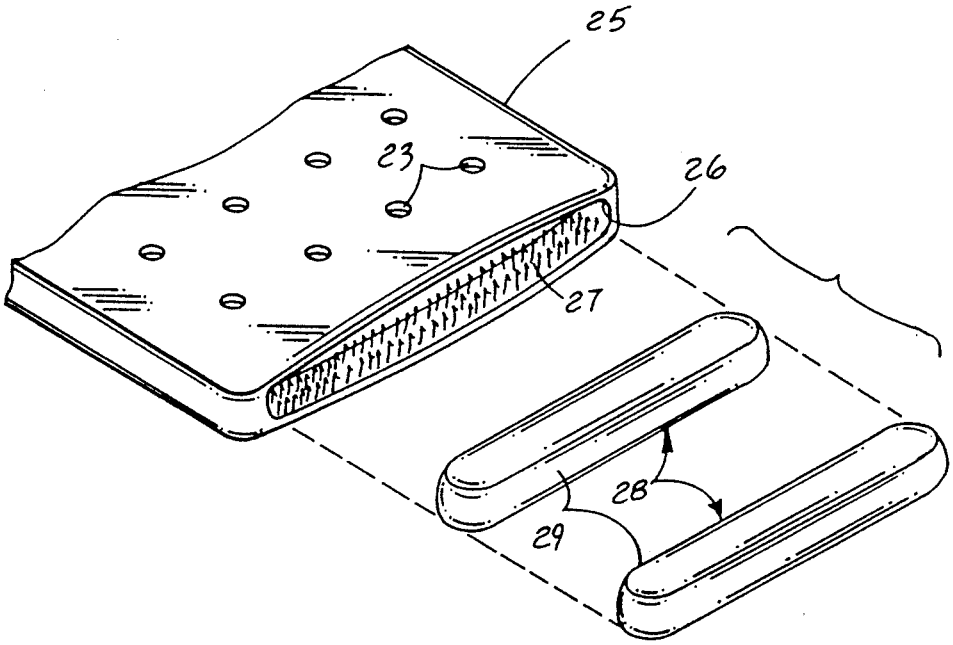
FIG. 8 is an isometric end view of a modified cushion insert utilized by the instant invention.
Figure 9:
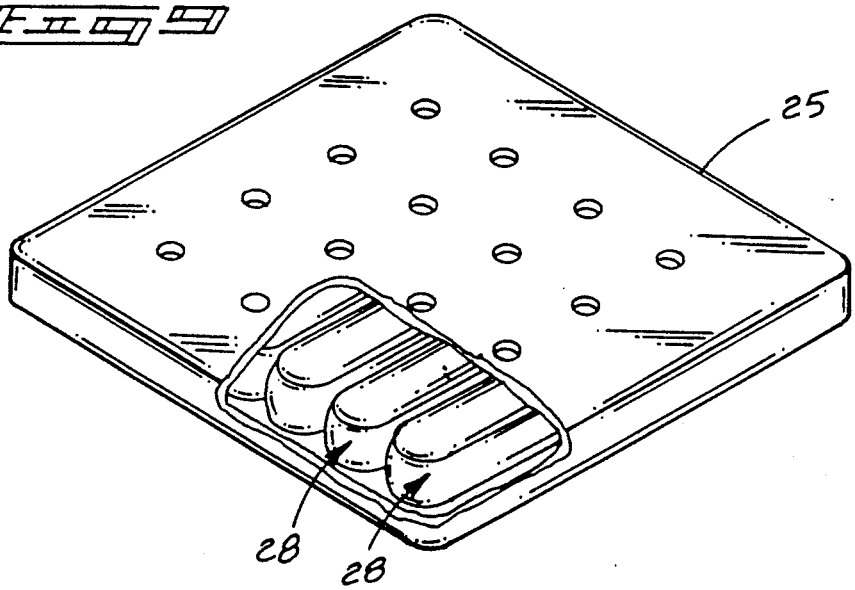
FIG. 9 is an isometric illustration of the cushion insert of the instant invention, partially in section.
Figure 10:
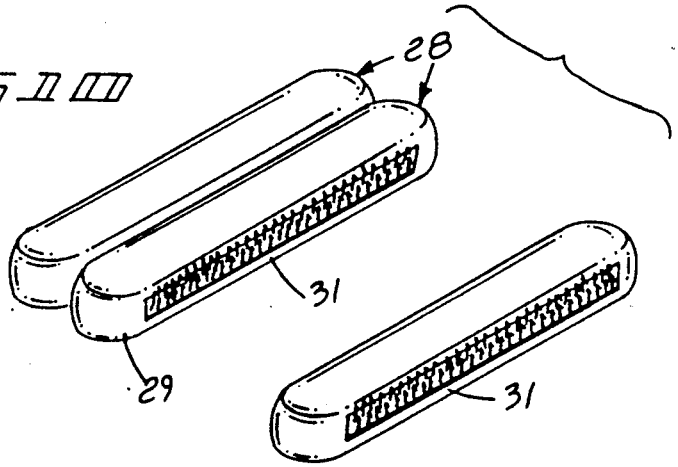
FIG. 10 is an isometric illustration of the individual cushion tubes utilized by the instant invention.
Figure 11:
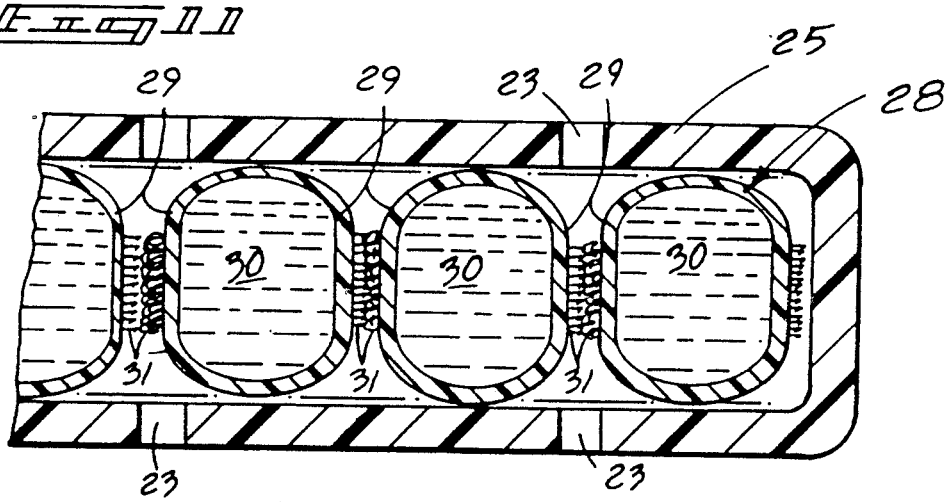
FIG. 11 is an orthographic cross-sectional view of the cushion insert and the cushion tubes utilized therewithin.

FIG. 8 illustrates a modified cushion insert housing 25 containing an elongate mouth opening 26 coextensively about one end of the modified housing 25, wherein a hook and loop mouth opening perimeter surface member 27 is formed to permit opening and closure of the elongate mouth opening 26. In this manner, the interior of the modified housing 25 is receptive to a selective number of elongate cushion tubes 28. The tubes 28 are formed of a resilient covering defined by planar side walls 29. A compressible fluid 30 is contained within each of the fully enclosed cushion tubes 28. Further, each of the planar side walls 29 includes mating hook and loop fastener surfaces 31 formed coextensively with each of the side surfaces 29 to permit securement of the tubes together. The fluid filled tubes 28 accordingly provide enhanced comfort in use of the modified cushion housing 25 and more particularly, a selective number of such tubes may be inserted to vary the rigidity of the cushion insert housings 25 utilized with each of the pockets 13 and 14.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A generally horizontal golf cart cushion for releasable securement to an associated golf cart, wherein the golf cart includes a generally horizontal platform for receiving the cushion, the cushion comprising, a first and second pocket, the first and second pockets longitudinally aligned relative to one another, including a transverse seam directed medially of the cushion defining rear terminal ends of each of the first and second pockets, and the first and second pockets including a respective cushion insert housing mounted within each pocket, wherein each of the first and second pockets defines a respective first and second pocket opening formed coextensively with a forward end of each pocket spaced from the transverse seam to selectively receive the cushion insert housing within each pocket, and strap means having a first end portions attached to said cushion adjacent said pocket openings, the strap means having second end portions with means adapted to connect the second ends of the strap portions to an associated golf cart

2. A cushion as set forth in claim 1 wherein a plurality of mounting loops are formed near each of the first and second pocket openings, and each of the loops includes an elastomeric strap securable thereto.

3. A cushion as set forth in claim 2 wherein the elastomeric straps of the each pair of mounting loops terminates at a common juncture spaced from the respective first and second pocket opening and includes a clip mounted at the juncture.

4. A cushion as set forth in claim 3 wherein each cushion insert housing includes a matrix of coil springs therewithin.

5. A cushion as set forth in claim 3 wherein each cushion insert housing includes a housing mouth opening, the housing mouth opening coextensive with an elongate side of each cushion insert housing, and each cushion housing is arranged to receive cushion means therewithin for providing selective rigidity to each cushion insert housing.

6. A cushion as set forth in claim 5 wherein each elongate mouth opening of each cushion housing insert includes a continuous hook and loop fastener surface to permit selective opening and closure of the elongate mouth opening.

7. A cushion as set forth in claim 6 wherein each cushion means includes a plurality of elongate cushion tubes receivable within each cushion insert housing, each elongate cushion tube is formed of a resilient covering including planar side walls, and each planar side wall includes a hook and loop fastener surface coextensive with each planar side wall to permit securement of adjacent planar side walls of the elongate cushion tubes together, and each elongate cushion tube includes a compressible fluid contained therewithin.

8. A cushion as set forth in claim 7 wherein the first and second pocket opening includes a respective first and second pocket hook and loop fastening loop formed within each first and second pocket opening to permit selective opening and closure of each of the first and second pocket openings to receive the cushion insert housings therewithin.

* * * * *